US005092385A

United States Patent [19]

Beaulieu

[11] Patent Number: 5,092,385

[45] Date of Patent: Mar. 3, 1992

[54] INTERLOCKING PANEL SYSTEM

[75] Inventor: Bryan J. Beaulieu, Burnsville, Minn.

[73] Assignee: Skyline Displays, Inc., Burnsville, Minn.

[21] Appl. No.: 718,591

[22] Filed: Jun. 21, 1991

[51] Int. Cl.[5] ..... A47G 5/00

[52] U.S. Cl. ..... 160/135; 160/231.2

[58] Field of Search ..... 160/135, 351, 231.1, 160/231.2; 52/239; 40/605

[56] References Cited

U.S. PATENT DOCUMENTS

| | | | |
|---|---|---|---|
| 2,210,652 | 8/1940 | Dennett | 160/135 X |
| 3,314,551 | 4/1967 | Plastow | 160/231.2 X |
| 3,403,720 | 10/1968 | Ahleen | 160/231.2 |
| 3,592,289 | 7/1971 | Aysta et al. | 160/135 |
| 3,809,142 | 5/1974 | Bleeker | 160/135 |
| 3,889,736 | 6/1975 | Firks | 160/135 |
| 3,987,836 | 10/1976 | LeMay | 160/135 |
| 4,144,924 | 3/1979 | Vanden Hoek | 160/135 X |
| 4,232,724 | 11/1980 | Brown | 160/135 |
| 4,250,676 | 2/1981 | Presby | 160/135 X |
| 4,344,475 | 8/1982 | Frey | 160/135 |

*Primary Examiner*—David M. Purol

*Attorney, Agent, or Firm*—Palmatier & Sjoquist

[57] ABSTRACT

An interlocking panel system having individual thin-walled sections, each section being supported by a rectangular frame formed of edge strip material. Each edge strip is constructed with an outwardly facing interlocking channel, to permit interlocking engagement of hinges and other connectors. The system includes a flexible hinge assembly which has outer edges shaped to slidably engage into the edge strips, and locking levers for indexing and affixing the respective flexible hinges in locked relationship to the panel sections. The edge strips also have selectively positioned locating holes and a slidable bar is movable into position along the edge strips, to permit the attachment of locating pins and feet for the various panel sections.

11 Claims, 3 Drawing Sheets

INTERLOCKING PANEL SYSTEM

BACKGROUND OF THE INVENTION

The present invention relates to portable exhibit display systems; more particularly, the invention relates to an exhibit display system which is constructed from a plurality of panels, wherein the respective panels may be arranged in a multitude of interlocking configurations.

In the portable exhibit display field, it is important that devices utilized for display purposes have a pleasing appearance, while at the same time be constructed of lightweight materials which may be readily transported. It is also important that exhibit displays of this type be capable of disassembly or contraction into a very small package, so that the package may be easily transported from place to place. Portable exhibit displays which can be easily expanded into an erected state having a large surface area are advantageous, for the enlarged surface area provides a display surface for graphics and other visual display materials. In addition, it is advantageous if the assembled and erected exhibit display system has the ability to receive shelving for holding various display articles, and the shelving should be sufficiently sturdy to withstand some limited loading. In the erected position, the exhibit display should present a pleasing, continuous appearance and should be capable of freestanding without external supports, and should have stability and strength in both the erected and contracted states.

Portable exhibit displays of the type described herein are typically transported in travel cases, and it is a particular advantage if the portable exhibit display can be broken down into sufficiently small modules or packages so as to be amenable to transport in a case which can be easily handled by a single person. This requirement dictates that the panel structure be made from lightweight materials, but the materials must be sufficiently durable so as to withstand repeated usage.

SUMMARY OF THE INVENTION

The present invention includes a plurality of thin, rectangular panels having an edge construction which permits releasable, interlocking engagement of adjacent panels. The invention also includes a flexible hinge which may be selectively interlocked between adjacent panels to permit the erection of a panel system having the facility for erection along a curved line or along a combination of irregular lines. The invention also includes an engagement feature which permits the vertical stacking of adjacent panel sections and also permits the addition of adjustable feet beneath the overall panel assembly.

A principal object and feature of the present invention is a rectangular panel having an edge construction which permits interlocking engagement of various types of fasteners.

Another feature and advantage of the present invention is a flexible hinge member having releasable locking members for engaging against the panel edges.

Another feature and advantage of the present invention is a threadable insert for engagement by the panel edge structure, which permits the threadable attachment of locating pins for vertical stacking of panel sections, or the threadable attachment of adjustable feet along a bottom edge of one or more panel sections.

The foregoing and other objects and advantages of the invention will become apparent from the following specification and claims, and with reference to the appended drawings.

DESCRIPTION OF THE PREFERRED EMBODIMENT

Figure 1:
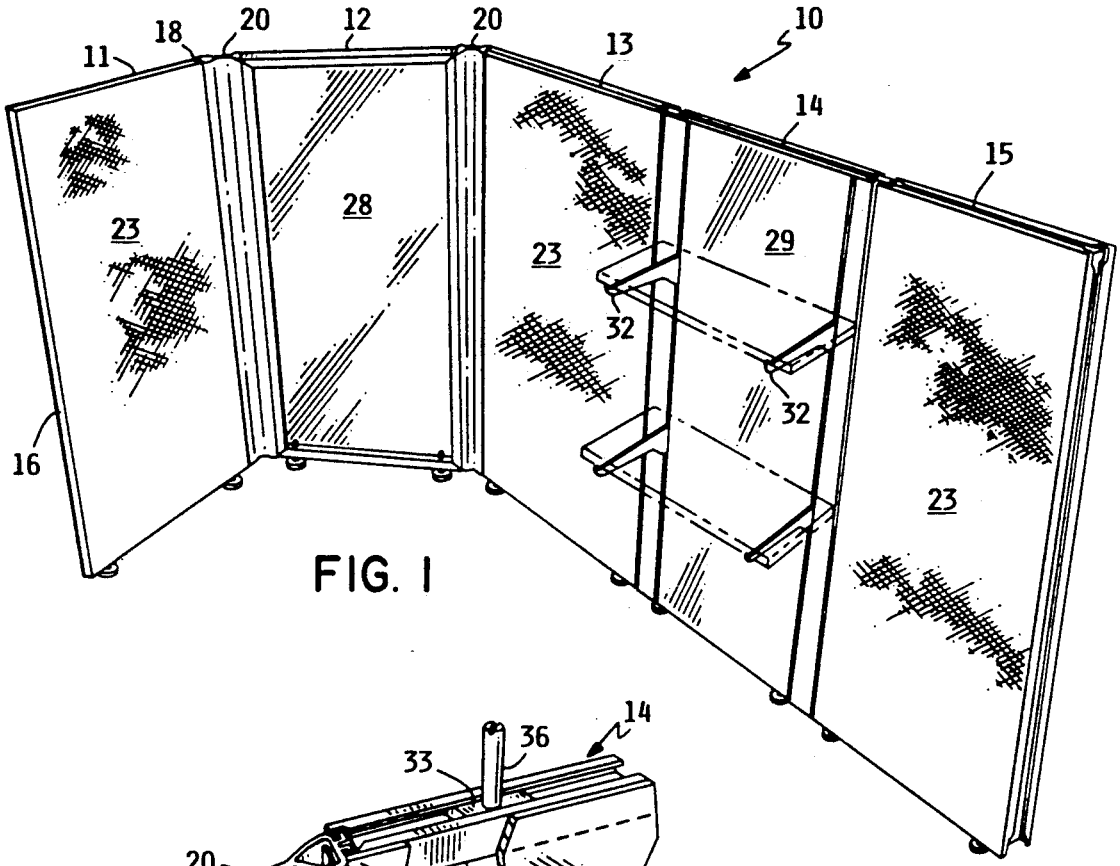
FIG. 1 shows an isometric view of one form of the invention in erected condition.

Referring first to FIG. 1, one form of the invention is shown in isometric view. As will become apparent, the number of different forms in which the invention may be used is virtually limitless, since the invention is capable of assemblage of a wide variety of vertical and horizontal stack sections. Furthermore, the invention is capable of utilization of any combination of flexible interlocking hinges to permit a limitless number of adjacent panel alignments. FIG. 1 shows a panel system 10 which is made from five panel sections 11–15. Each of the panel sections 11–15 is in some respects different from any other section and in some respects identical to every other section. All of the panel sections have identical edge constructions, which will be described hereinafter in greater detail.

Panel section 11 has an outer exposed edge 16 and an inside edge 18 which is engaged in interlocking relationship with a flexible hinge 20. Panel section 12 has each of its two vertical edges engaged in interlocking relationship with flexible hinges 20. Panel section 13 has one of its vertical edges engaged in interlocking relationship with a flexible hinge 20 and the other edge engaged in rigid interlocking relationship with panel section 14. Panel section 14 has both of its vertical edges engaged in rigid interlocking relationship with the respective adjacent panels. Panel section 15 has an inside edge engaged in rigid interlocking relationship with panel section 14 and has an exposed outer edge.

Figure 2:
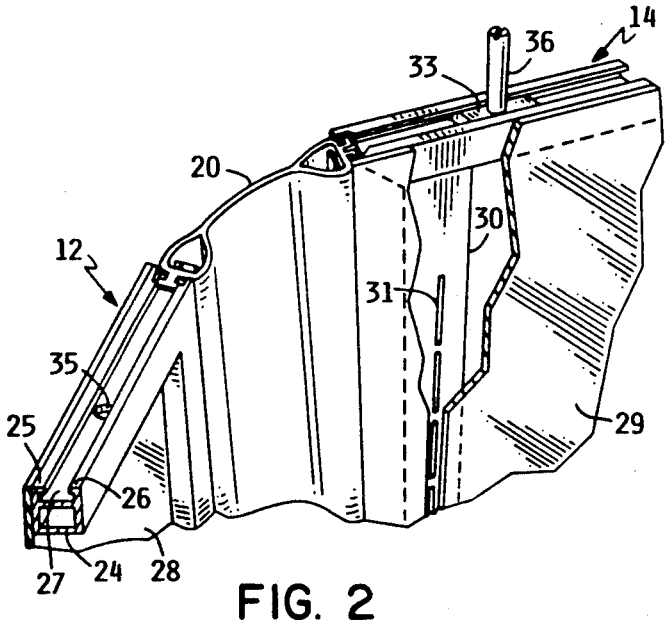
FIG. 2 shows an expanded view of a portion of the invention, in partial breakaway.
Figure 3:
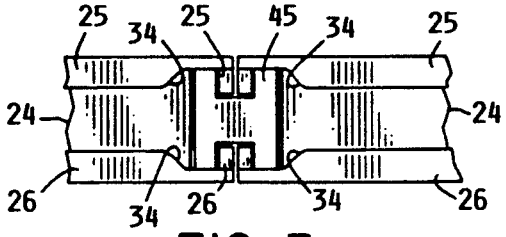
FIG. 3 shows an enlarged top view of a pair of panel section interlocking edges.

The construction features which are common to all panel sections include the panel edge construction, which is best shown in FIG. 2. The peripheral edges of all panels are formed of an edge strip material 24, which in the preferred embodiment is preferably made from extruded aluminum. Edge strip 24 has a pair of inwardly directed tabs 25, 26, which together create a channel 27 for interlocking engagement of various devices, as for example, flexible hinge 20. At the intersecting corners of two edge strips 24, a portion of the respective tabs 25, 26 are milled or cut back so as to permit clearance for slidable and interlocking relationship along either of the orthogonal edge strips 24. The milled portion 34 of tabs 25, 26 is best shown in FIG. 3.

Each of the panel sections may be covered with the same or different materials. For example, FIG. 1 shows panel sections 11, 13 and 15 having a fabric covering 23. This fabric covering may be applied to both sides of the respective panels sections or may be applied to only a single side. Panel section 12 has a single plastic surface covering 28. Surface 28 may be a rigid or semi-rigid plastic surface, and may be applied to either or both sides of panel section 12. Panel section 14 is covered by a plastic covering 29, which is split into three sections in order to accommodate and expose the plurality of slots 31 in interior rails 30. The slots 31 in rails 30 are sized to accommodate standard shelf brackets 32, to permit one or more shelves to be hung in close engagement against panel section 14. Rails 30 are affixed against the inside of edge strips 24 so as to be rigidly contained within the frame structure formed by edge strips 24. FIG. 2 shows a panel section 14 connected to a panel section 12 by means of a flexible hinge 20. The breakaway portion of FIG. 2 illustrates the positioning of a rail 30 and the exposed slots 31 in rail 30. The outer plastic cover 29 is sectioned so as to provide exposed access to slots 31.

Figure 5:
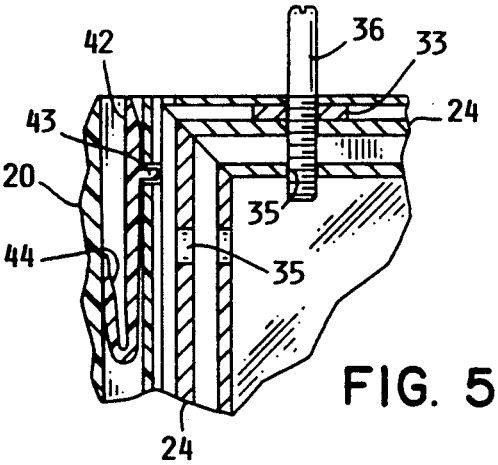
FIG. 5 shows a cross-sectional view taken along the lines 5—5 of FIG. 4.
Figure 6:
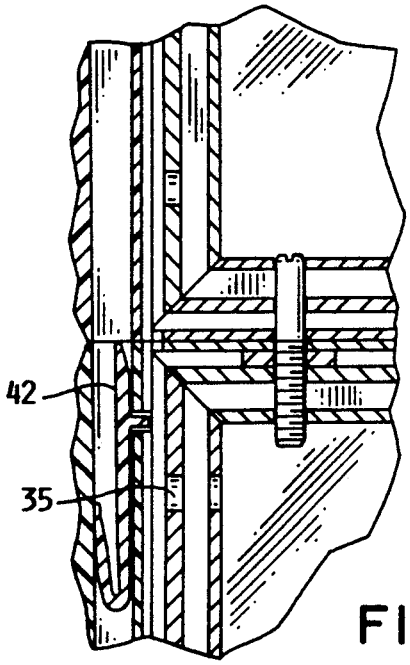
FIG. 6 shows a cross-sectional view similar to FIG. 5, with panel sections arranged in stacked alignment.

A hole 35 is drilled through edge strip 24 at a predetermined distance from each intersecting corner of edge strip 24. Hole 35 provides an access hole to permit the mounting of various further appliances to edge strips 24. For example, FIG. 2 shows a slidable bar 33 which is positioned in the channel 27 formed within edge strip 24, at a location immediately above a hole 35. Slidable bar 33 has a threaded hole therethrough sized to accommodate a threaded pin 36. Threaded pin 36 may be fastened into slidable bar 33 and tightened until its internal end is secured through edge strip 24, as is best illustrated in FIG. 5 and FIG. 6 in cross-sectional view. A further purpose for hole 35 in slidable bar 33 is to provide a means for securing a mounting foot 40 into a panel section as is illustrated in cross-sectional view in FIG. 7.

Figure 8:
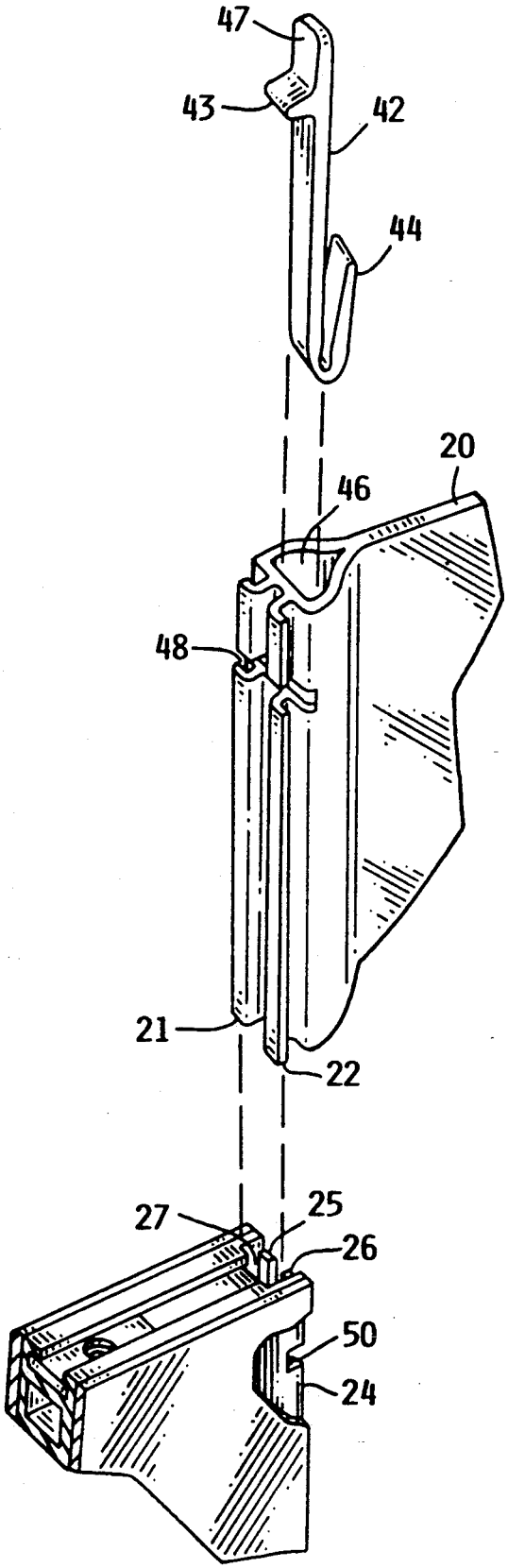
FIG. 8 shows an exploded view of a panel interlocking mechanism.

The flexible hinge 20 is preferably made from extruded plastic material so as to provide a flexible connection between adjacent panel sections. The outer edges of flexible hinge 20 are designed with a pair of projecting ears 21, 22 which are sized for slidable engagement into the channel 27 formed by tabs 25, 26 of edge strip 24, as is best shown in FIG. 8. Flexible hinge 20 may be covered with a fabric material on each of its outer surfaces, particularly in the case wherein the hinge is used to interconnect two panel sections which are similarly fabric covered. In this application, a fabric-covered hinge 20 joining together two fabric-covered panel sections gives the appearance of a continuous fabric covering over the entire combination. Alternatively, the flexible hinge 20 may be made in colors and/or textures to provide either a unique contrast or blending between the adjacent panel sections to which it is attached.

FIG. 3 shows a top view of two panel sections which are rigidly interconnected through the use of a rigid connector bracket 45. Connector bracket 45 may be made from extruded aluminum, or other rigid material, and is constructed to have spaced-apart ears to respectively engage into adjacent channels 27, so as to closely align two adjacent panel sections. The milled portion 34 enables a connector bracket 45 to be slidably engaged into the adjacent panel section channels, so as to interlock against the respective tabs 25, 26 of adjacent vertical channels. Since connector bracket 45 is slidably engageable into the respective channels, it may also be removed for disassembly of the adjacent panel sections. Connector bracket 45 is particularly adaptable in cases where adjacent panel sections are to be held in rigid side-by-side interlocking relationship to form an overall larger straight panel appearance. FIG. 1 illustrates the use of connector brackets 45, interconnecting panel section 14 with panel sections 13 and 15. This construction is useful in creating an overall larger panel appearance along a straight line as illustrated.

Figure 4:
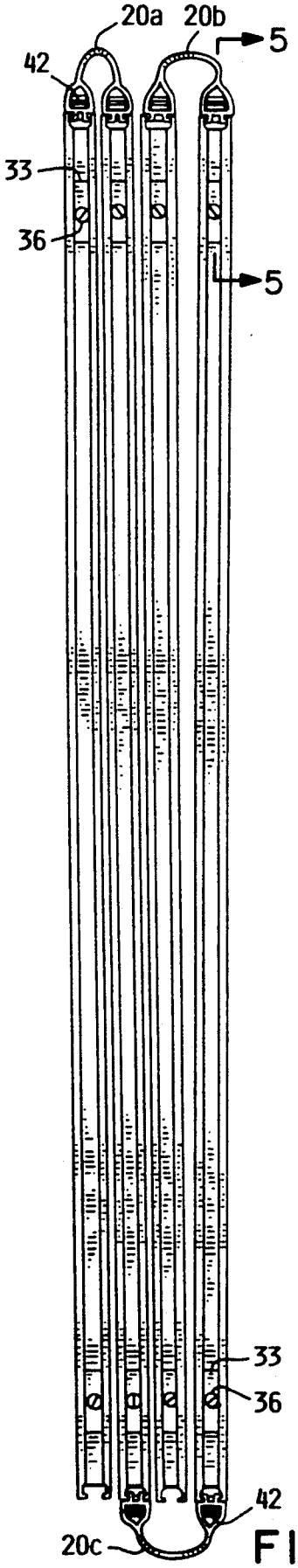
FIG. 4 shows a plurality of panel sections in contracted form.

FIG. 4 illustrates a top view of panel sections in folded form, to demonstrate the further unique features of flexible hinge 20. A flexible hinge 20*a* interconnects two panel sections which are folded adjacent one another, thereby to provide side-by-side folding capability. Flexible hinge 20*b* interconnects two panel sections which are in side-by-side alignment, but slightly spaced apart in a position which would permit the storage of certain flat materials between the panel sections. Flexible hinge 20*c* is shown interconnecting two panel sections which are folded, but folded with an intermediate panel section therebetween. Therefore, the use of flexible hinge 20 permits a variety of foldable positions for the respective panel sections which are interconnected by flexible hinges.

Figure 7:
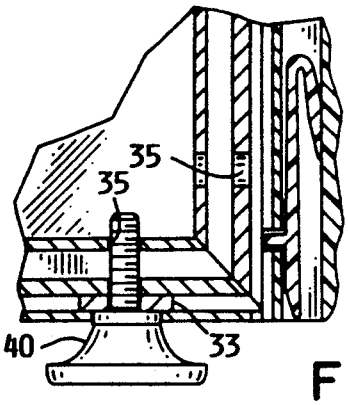
FIG. 7 shows a cross-sectional view of a lower panel section to illustrate the threadable foot.

FIG. 5 shows a cross-sectional view of a panel section, illustrating the use of a threaded pin 36 and slidable bar 33 in combination with edge strip 24. Pin 36 may be threaded completely into slidable bar 33, so as to project inwardly entirely through the thickness of edge strip 24. In this manner, the threaded pin provides a projecting locating and positioning pin for stacking of panels, as shown in FIG. 6, while at the same time being rigidly supported within an edge strip 24. FIG. 7 illustrates a similar utilization to enable the attachment of a foot 40 through the slidable bar 33.

FIGS. 5 through 7 also illustrate in cross-sectional view the positioning of a locking lever 42. Locking lever 42 has a projecting index 43 which engages into a slot in edge strip 24 for securing a flexible hinge 20 in non-moving relationship to edge strip 24. Locking lever 42 is preferably made from a resilient material such as plastic, and has a resilient hooked end 44 which presses outwardly against the interior channel formed within a flexible hinge 20. The construction and use of locking lever 42 is best illustrated with reference to FIG. 8. Locking lever 42 is inserted into channel 46 which is a part of flexible hinge 20, thereby compressing the hooked end 44 inwardly. As locking lever 42 is further inserted into channel 46, index 43 becomes located in a slot 48 which is cut across the edge of flexible hinge 20. A complementary slot 50 is formed across the vertical edge strip of all panel sections. Therefore, when flexible hinge 20 is slidably engaged in interlocking relationship into channel 27, the locking lever 42 is carried along with flexible hinge 20 until index 43 engages through slots 48 and 50. In this position, index 43 resiliently moves outwardly to interlock flexible hinge 20 in fixed contact against edge strip 24. A flexible hinge 20 may be removed from this fixed engagement against edge strip 24 by merely pulling back the end 47 to release index 43 from engagement with the respective slots.

In operation, the panel section frames are initially assembled by affixing four edge strips into a rectangular frame configuration, and by drilling the respective holes 35 a predetermined distance from each of the corners of the intersecting edge strips. The vertical edge strips are slotted to provide for possible engagement by locking levers 42. The flexible hinges are prepared by an extrusion process, and after extrusion the respective slots 48 are formed at predetermined distances from the respective ends of flexible hinge 20. The locking lever 42 is inserted into the flexible hinge 20, and is carried by the flexible hinge until the hinge is ready for use with the system. A particular exhibit display panel configuration is then selected, and appropriate fabrics and other coverings are selected for the various panel sections to be utilized in constructing the overall display system. The various panel section covers are applied to the frames comprised of edge strips previously prepared, and adjacent panel sections are aligned for interconnecting by means of flexible hinges 20. In the case of panel sections which are to be rigidly interconnected, a connector bracket 45 is prepared for assembly at the site location where the display system is to be utilized. In the case where stacked combinations of panel sections are to be utilized, each succeeding vertical stacked level of display panel system is initially assembled, and is prepared for final assembly at the site, by attaching the requisite flexible hinge members and other locating pins, so that the final panel system may be fully assembled at the site. All the panel sections may then be folded into a compact form and carried by a carrying case for transport to a site, and they may be readily reassembled into a full display system on site.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A portable exhibit display system including a plurality of thin-walled panels and means for interlocking said panels in edgewise alignment, comprising:

a) each panel comprising a rectangular frame formed of edge sections of extruded material, said extruded material having a cross section forming an edge channel between and beneath two inwardly-directed ears, and at least one sheet of material covering the area defined by said rectangular frame; and b) said means for interlocking said panels in edgewise alignment comprising a plurality of interlocking members made of extruded material, each interlocking member having two outside edges with a cross section complementary shaped to said edge channel cross section, and means for slidably inserting said interlocking members into engagement in said edge channels; at least one interlocking member having a flexible hinge member bridging between said two outside edges; and an open channel between said flexible hinge member and each of said outside edges, and a spring-locking member located in each of said open channels.

2. The apparatus of claim 1, further comprising a transverse slot opening between said open channel and the outside of said outside edge, and a transverse index tab on said spring-locking member, said index tab projecting through said transverse slot.

3. The apparatus of claim 2, further comprising a transverse slot formed into the outside edge of at least one of said frame edge sections, said slot being aligned to accept said index tab.

4. The apparatus of claim 3, further comprising means for flexing said spring member to disengage said index tab from said transverse slot formed into the outside edge of said at least one frame edge sections.

5. The apparatus of claim 1, further comprising locating holes drilled through said edge sections at predetermined positions, said holes opening into said edge channels.

6. The apparatus of claim 5, further comprising at least one bar sized for slidable movement in said edge channels, said bar having a threaded hole therethrough, and means for aligning said threaded hole with one of said locating holes.

7. The apparatus of claim 6, further comprising a pin having a threaded end for fastening through said bar-threaded hole.

8. The apparatus of claim 7, wherein said pin is sized to fit into said locating holes.

9. The apparatus of claim 1, wherein at least one of said panels further comprises a pair of rails affixed between said edge sections, each of said rails having a plurality of outwardly facing slots adapted to receive shelf brackets.

10. The apparatus of claim 9, wherein said at least one of said panels further comprises an outer cover extending over the surface defined by said edge sections, said cover having a slotted opening aligned with each of said plurality of outwardly-facing slots.

11. The apparatus of claim 6, further comprising a threaded foot member fastened through said bar-threaded hole.

* * * * *